US006722605B2

(12) United States Patent
Joutsjoki

(10) Patent No.: US 6,722,605 B2
(45) Date of Patent: Apr. 20, 2004

(54) METHOD AND ASSEMBLY FOR TRANSFERRING TISSUE PAPER ROLLS OFF FROM A REEL SHAFT

(75) Inventor: Jukka Joutsjoki, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/266,375

(22) Filed: Oct. 8, 2002

(65) Prior Publication Data

US 2003/0034419 A1 Feb. 20, 2003

Related U.S. Application Data

(63) Continuation of application No. PCT/FI01/00372, filed on Apr. 12, 2001.

(51) Int. Cl.[7] ..... B65H 19/22
(52) U.S. Cl. ..... 242/533.7; 242/533.2
(58) Field of Search ..... 242/533.4, 533.5, 242/533.7, 559, 559.1, 559.2, 533.2; 414/911

(56) References Cited

U.S. PATENT DOCUMENTS

| | | | |
|---|---|---|---|
| 2,198,644 A | 4/1940 | Wettengel | |
| 3,712,554 A | 1/1973 | Lorenzini et al. | |
| 6,264,133 B1 | 7/2001 | Herrmann | |

FOREIGN PATENT DOCUMENTS

| | | |
|---|---|---|
| EP | 0 753 476 A1 | 1/1997 |
| GB | 1 327 549 | 8/1973 |
| GB | 1 549 137 | 7/1979 |
| WO | WO 96/15059 | 5/1996 |

*Primary Examiner*—John Q. Nguyen
(74) *Attorney, Agent, or Firm*—Alston & Bird LLP

(57) ABSTRACT

One or more tissue web rolls are transferred from the core shaft on which they are carried by an apparatus that includes a roll change tube that is moved into coaxial alignment with one end of the core shaft and engages the end of the shaft to support it. A pusher device pushes the tissue web rolls from the core shaft onto the roll change tube. The roll change tube is then pivoted to move the roll change tube away from the core shaft to position the tissue web rolls for delivery to a downstream process, and simultaneously a core change tube is moved into coaxial alignment with the core shaft so that new cores can be pushed from the core change tube onto the core shaft.

17 Claims, 7 Drawing Sheets

METHOD AND ASSEMBLY FOR TRANSFERRING TISSUE PAPER ROLLS OFF FROM A REEL SHAFT

CROSS-REFERENCE TO RELATED APPLICATIONS

This application is a continuation of International Patent Application PCT/FI01/00372 filed Apr. 12, 2001, incorporated herein by reference, which designated inter alia the United States and was published in English under PCT Article 21(2).

FIELD OF THE INVENTION

The present invention relates to a method for transferring rolls of soft paper grades, also known as tissue paper grades, that are rolled on core shafts to further processing. The invention also relates to an apparatus suitable for implementing the method.

BACKGROUND OF THE INVENTION

In the art of papermaking, high bulk paper grades, also known as soft paper grades, are generally called tissue webs. Tissue webs also include silk paper grades. Tissue web finds particular use in various products requiring good absorbency, such as towels and napkins, diapers and the like. For these products, tissue web is subjected to further processing in order to make the absorbent pads or other liquid-receiving bulk portions needed in the final product. All of these raw material grades are characterized by high compressibility even under small compressive forces, as well as a low specific weight in regard to their volume.

Due to their high compressibility, the handling of tissue web rolls is difficult. It is desirable that the large specific volume of the product per unit weight be retained as unchanged as possible through all the manufacturing steps up to the end user in order to maintain the qualities of the product at an optimally high level. As such web rolls tend to collapse easily, the handling of the rolls must be carried out with maximum caution to roll damage so that the rolls are not subjected to high forces nor supported on their outer plies. One problem in the handling of rolls is associated with the removal of the set of parent rolls from the core shafts. In the production of soft tissue webs wider than about 5000 mm, the web leaving the papermaking machine is slit into two or more partial-width webs prior to winding, and the partial-width webs are wound onto individual cores on the core shafts to form a plurality of partial-width parent rolls. Prior to the start of the winding, the cores are already threaded onto the core shafts and thus the tissue paper rolls wound from the slit web have a width which is directly suitable for the further processing steps. Herein, a problematic phase occurs in the removal of the set of parent rolls from the core shaft. If the parent rolls are still supported by the core shaft on the reel rail, the core shaft cannot be pushed out from the rolls without an external support of the rolls. The friction between the core and the core shaft caused by the weight of the parent rolls resting on the shaft would prevent free sliding of the core shaft. In one prior-art method, this problem has been solved by supporting the parent rolls by their outer plies, whereby the weight of the rolls is relieved from resting on the core shaft. However, this arrangement involves the risk of reducing the caliper of the tissue web as a result of the externally applied forces from the weight of the rolls. Additional problems can result from the elasticity of the wound web causing the wound parent rolls to expand after the compressive pressure of the core shaft is removed. The winder of a prior-art arrangement is provided with a lift table that supports the parent roll and a downward sloped rolling ramp for transferring the rolls from the winder. For the handling of the core shaft, this apparatus construction is provided with core shaft puller means and other means for threading new cores onto a free shaft. Obviously, such supporting of the tissue web parent roll and the free rolling off the rolling ramp can readily degrade the compressibility properties of the tissue web and thus impair parent roll quality.

SUMMARY OF THE INVENTION

An object of the present invention is to provide a method and apparatus for supporting tissue parent rolls by their cores during their removal from the core shaft and, advantageously, also during their transfer to the further processing steps.

The goal of the invention, to remove the set of parent rolls from the core shaft while maintaining the quality of the wound paper, is achieved by supporting the core shaft at one end by a support such as a rail and at the other end by a roll change tube whose outer diameter is equal to that of the core shaft and whose end is operable to engage and support the end of the core shaft. When the core shaft is connected to the roll change tube, the rolls wound on the core shaft can be pushed onto the roll change tube outside the reel and then transferred to a pole truck pick-up position for further processing or storage.

The invention offers significant benefits. By virtue of the method, tissue parent rolls can be transferred so that they are supported by their cores in a continuous manner when they are pulled from the support of the core shaft, whereby there is no need to grab the roll or support the same by the outer plies of the roll. Hence, the risk of roll compression and damage can be eliminated from these steps of roll processing. The removal of parent rolls from the winder after being wound on a core becomes extremely fast and a new core shaft with the cores threaded thereon is rapidly placed into the vacant position of the just removed shaft. As the construction of the core-handling assembly is extremely uncomplicated, its cost as compared with its high roll-handling capacity remains very low. Furthermore, parent rolls removed from the core shaft can be handled by a lift truck having core chuck arms, whereby any post-processing of the rolls can be carried out without supporting the parent rolls by their outer plies.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
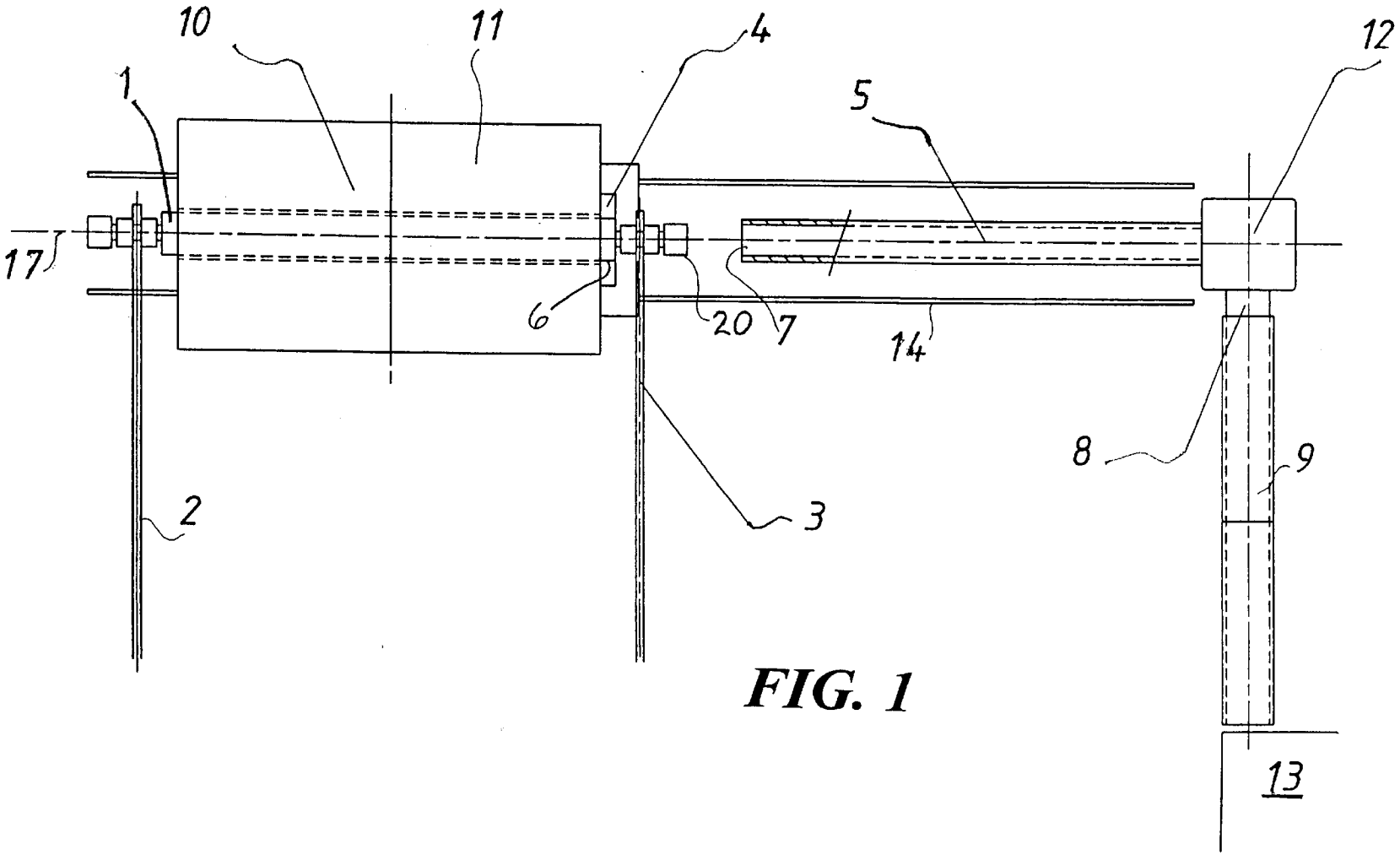
FIG. 1 shows a diagrammatic view of an embodiment according to the invention performing a first step of the method.

The assembly according to the invention is mounted to operate in conjunction with a winder of a tissue-making paper machine. In the arrangement illustrated in FIG. 1, parent rolls 10, 11 are transported along transfer reel rails 2, 3 starting from the winder to a changer of a core shaft 1. The core shaft comprises a shell portion 6 for supporting at least one roll core 9 and at least one coupling portion 20. At the reel changer, the reel rails 2, 3 terminate at rotatable supports 15 having crosswise aligned rails 14 located below the supports 15. A lift fork 4 is adapted to be movable on these crosswise rails 14. The fork 4 has at its end a slot 16 suitable for supporting the end of the core shaft 1. The rails 14 are adapted to extend beyond the width of the reel shaft 1 and the height of the lift fork 4 is dimensioned so that the fork 4 can move on the rails 14 underneath the core shaft 1 and the parent rolls 10, 11. At the opposite end of the lift fork 4 transfer rails 14, a roll core handler 12 is located adjacent to the core shaft reel rails 2, 3. The core handler 12 comprises a roll change tube 5 and a core change tube 8 cantilever mounted thereon. The roll change tube 5 and the core change tube 8 are mounted at a mutual 90° angle on the body of the roll core handler 12 and adapted to be rotatable so that either one of tubular charger tubes 5, 8 can be rotatably aligned parallel to the rails 14 and the center axis 17 of the core shaft 1. Additionally, the roll core handler 12 is made transferable, e.g., along the rails 14 of the lift fork in a parallel direction to the central axis 17 of the core shaft 1. Further, the roll core handler 12 is complemented with a core-handling table 13 in a position meeting the core change tube 8 when the roll change tube 5 is aligned parallel to the central axis 17 of the core shaft 1.

Figure 6:
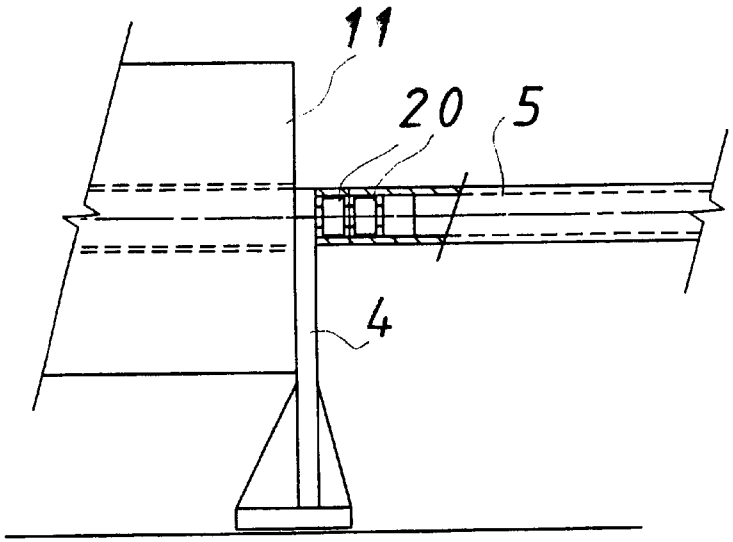
FIG. 6 shows another detail of the embodiment of FIG. 1.
Figure 5:
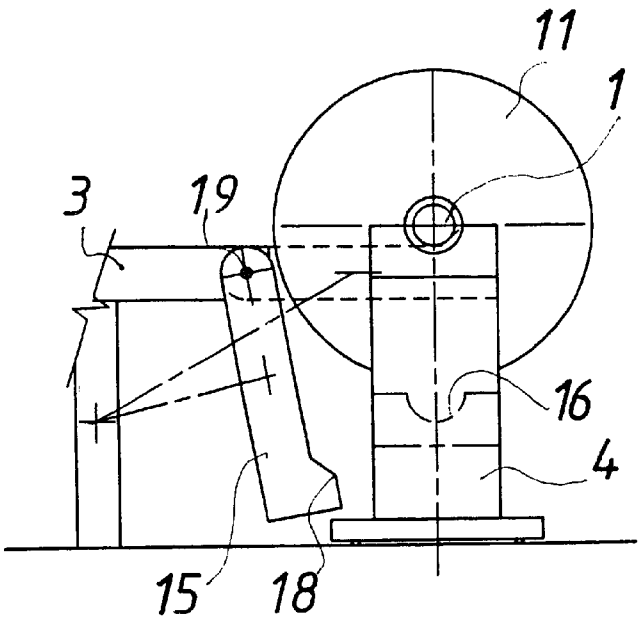
FIG. 5 shows a detail of the embodiment of FIG. 1.

Now referring to FIGS. 5 and 6, there are shown some details of the construction of the lift fork 4, the core shaft support 15 and the end of the roll change tube. The core shaft support 15 is implemented in the form of a rail as an extension of the transfer rail 3 and has a stop 18 at its end for stopping the movement of the reel shaft 1. The support 15 is mounted on the end of the transfer rail 3 so as to be rotatable about a pivotal joint 19. The lift fork 4 has a round slot 16 with a shape compatible with the outer shape of the core shaft 1. An alternative technique is to use, e.g., a V-shaped slot, whereby a single lift fork can be used for supportably lifting core shafts of different diameters. However, papermaking factories generally use only core shafts of the same size. The height position of the lift fork 4 as seen from the level of the rails 14 is adapted such that the fork 4 may be moved under the largest roll 11 to be handled in the roll change position without interfering with the roll 11.

The outer diameter of the roll change tube 5 is dimensioned to be compatible with the inner diameter of the roll cores 9 used at the winder. The end of the roll change tube 5 is provided with an inner bushing whose inner diameter is compatible with the outer diameter of a coupling portion 20 adapted to the end of the core shaft, whereby the outer diameter of the coupling portion must be made smaller than the outer diameter of the core shaft shell. The end of the roll change tube 5 can be slidably fitted on the coupling portion 20 so that the end of the tube 5 remains resting on the end of the shell of the core shaft 1 that provides support to the roll cores 9. The diameters of the roll-supporting shell portion of the core shaft 1 and the roll change tube 5 are preferably made equal. The end of the roll change tube 5 need not necessarily have a shaped bushing, but instead, the inner diameter of the tube 5 may be directly made compatible with the outer diameter of the core shaft coupling portion 20.

The function of the roll-handling system according to the invention is as follows.

Figure 2:
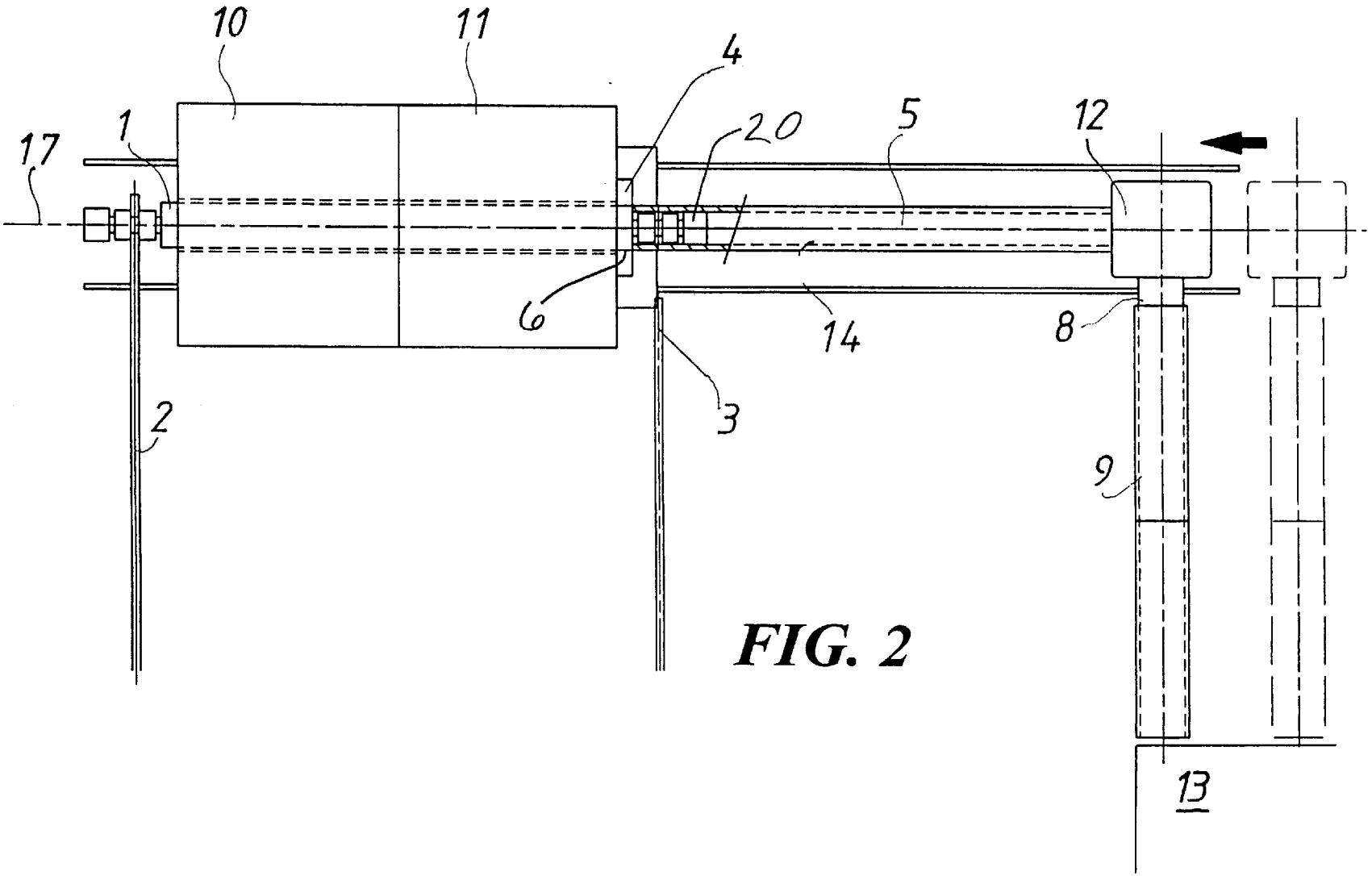
FIG. 2 shows a diagrammatic view of the embodiment of FIG. 1 performing a second step of the method.
Figure 3:
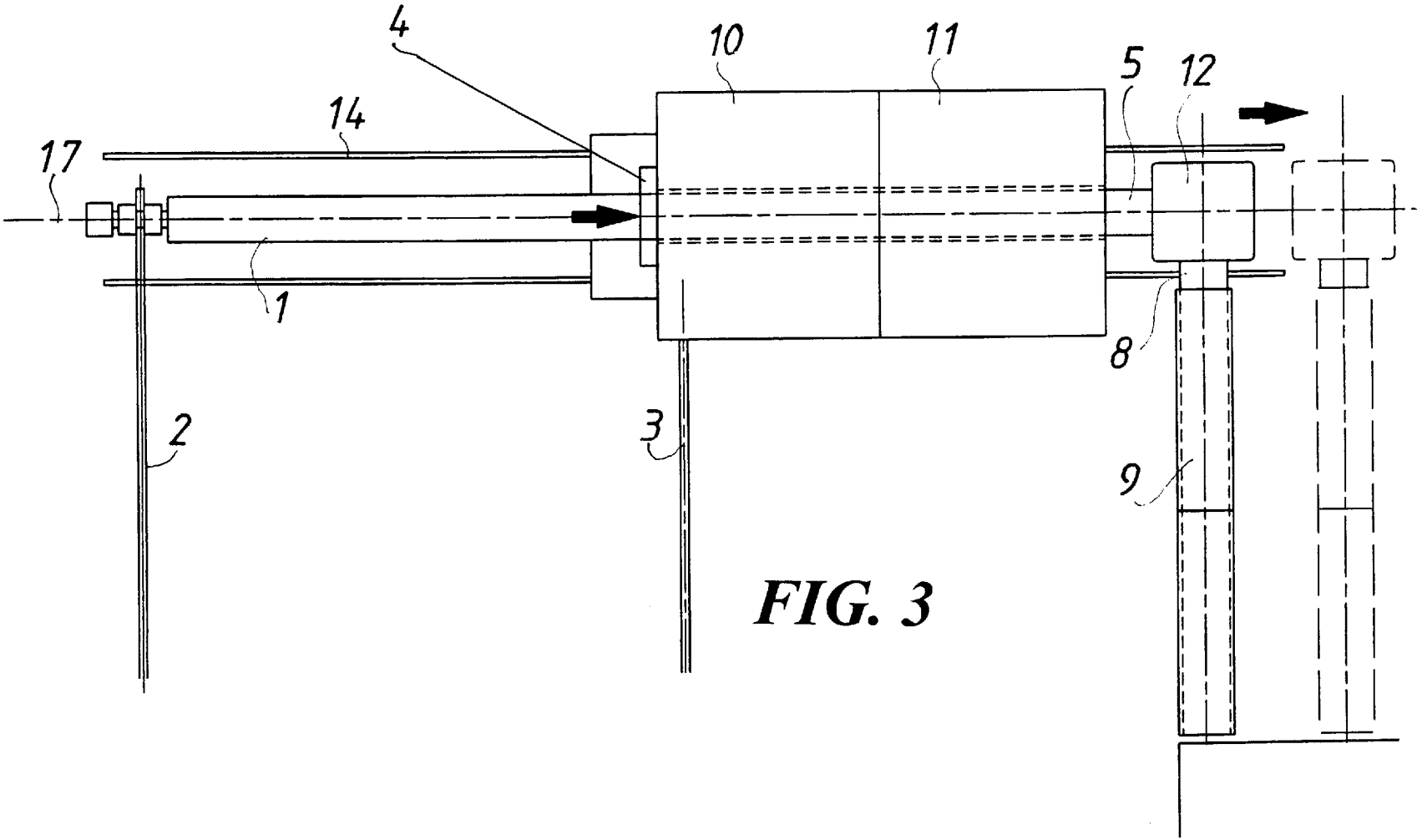
FIG. 3 shows a diagrammatic view of the embodiment of FIG. 1 performing a subsequent step of the method.

The core shaft 1, which in the exemplifying embodiment is shown having two rolls 10, 11 resting thereon, is rolled off from the slitter of a tissue-web-making machine up to the end of the transfer reel rails 2, 3. One of the transfer rails has its end equipped with the above-mentioned rotatable support 15, whereby the core shaft 1 can remain resting on the end of the second transfer rail 3 and the support 15. Next, the lift fork 4 is elevated to bear the load of the core shaft 1 at that end of shaft which is resting on the support 15, that is, the shaft removal end, and the support 15 is rotated downward away from the core shaft 1 and the rolls 10, 11. The roll change tube 5 is next moved by the roll core handler 12 against the shell end of the core shaft 1 (see FIG. 2), whereby the core shaft 1 remains resting by its coupling portion 20 on the end of the roll change tube 5. It must be noted, that the lift fork 4 supports the core shaft 1 over its shell portion so that the roll change tube 5 can be threaded fully home against the end of the shaft shell. While the core shaft 1 is resting on the roll change tube 5, the lift fork 4 moves down and travels on the rails 14 toward the other end of the core shaft 1 up to a position between the transfer rail 2 and the roll 11 resting on the core shaft 1, and then rises against the shell of the core shaft 1. The lift fork 4 is then moved on the rails 14 to push the rolls 10, 11 resting on the core shaft 1 onto the roll change tube 5 that essentially forms an extension of the shell portion of the core shaft 1. The lift fork 4 pushes the rolls at the ends of the roll cores 9 and, as the cores are abutting each other, there is no need to impose the pushing force on the ends of the rolls 10, 11. Even here, the lift fork 4 provides support to the end of the outermost roll 11. Obviously, a separate fork-shaped pusher can be used in lieu of the lift fork. The core shaft 1 is prevented from moving with the roll cores 9, since the stationary roll transfer reel rail 2 and the roll change tube 5 lock the core shaft 1 stationary in regard to its movement along its longitudinal center axis.

Next, the lift fork 4 moves to provide support to the core shaft 1 at its change-side end and, simultaneously, the roll change tube 5 is withdrawn to disengage the coupling portion 20. After the roll change tube has disengaged the coupling portion 20 and has rolls 10, 11 on it, the roll core handler rotates 90° about its pivot point which is located on the extension of the core shaft longitudinal axis, which causes the core change tube 8 with new roll cores 9 threaded thereon to be aligned with the roll shaft center axis 17 so that the core change tube can be threaded in until pushed against the shell end of core shaft 1. Next, the lift fork 4 is lowered down and the roll cores 9 are pushed onto the core shaft 1, then the lift fork 4 is elevated up again and the core change tube 8 is detached from the core shaft end by the movement of the roll core handler 12. As the next step, the support 15 is free to be rotated into a position under the core shaft 1 and, simultaneously, the lift fork 4 is lowered, whereupon the core shaft 1 can be transferred with the new roll cores threaded thereon ready for the next operation at the winder of the papermaking machine.

Figure 4:
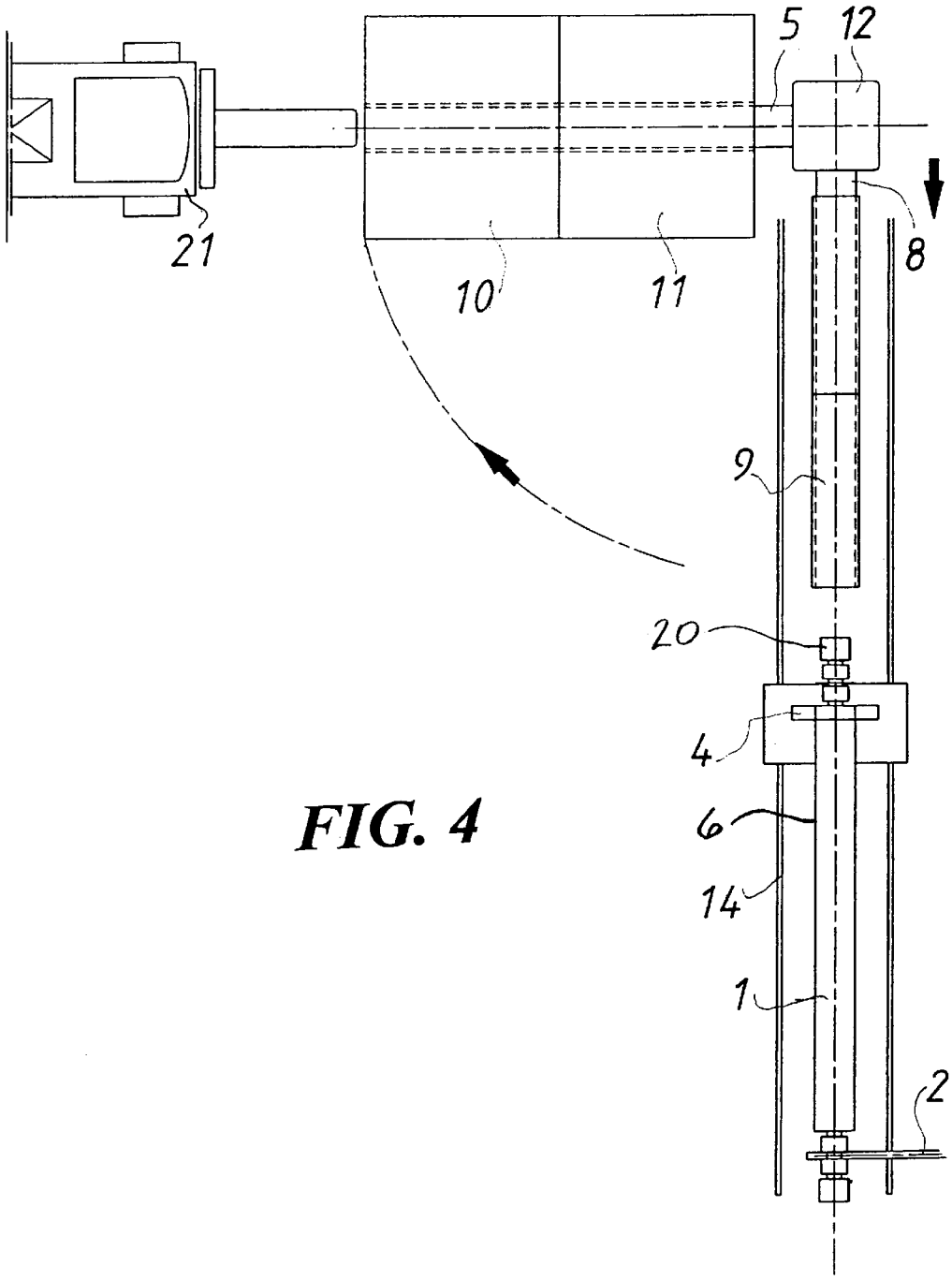
FIG. 4 shows a diagrammatic view of the embodiment of FIG. 1 performing a next subsequent step of the method.

As shown in FIG. 4, the rolls 10, 11 can be removed from the roll change tube 5 by using, e.g., a transfer truck 21 equipped with core chucks. After the removal of the rolls 10, 11, the roll core handler 12 is rotated back into its home position, whereupon the roll change tube 5 is ready to receive new rolls and the new cores can be threaded onto the core change tube 8. The loading of the core change tube 8 can be made manually or by an automatic core loader.

Figure 7:
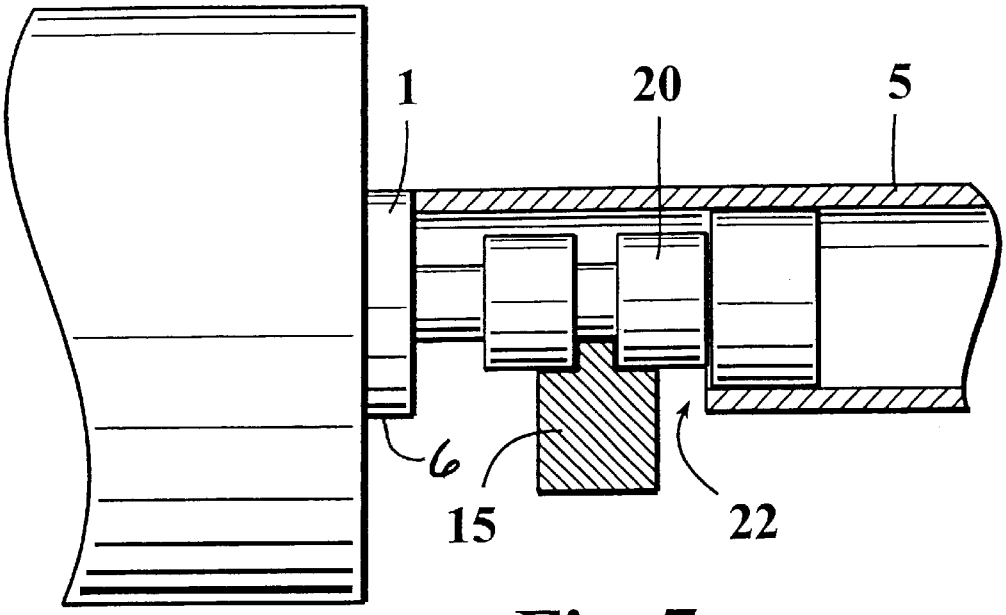
FIG. 7 shows a detail of a preferred embodiment of the invention.
Figure 8:
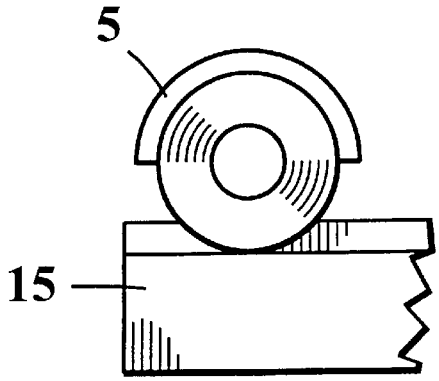
FIG. 8 shows a detail of the embodiment of FIG. 7 viewed from another direction.
Figure 9:
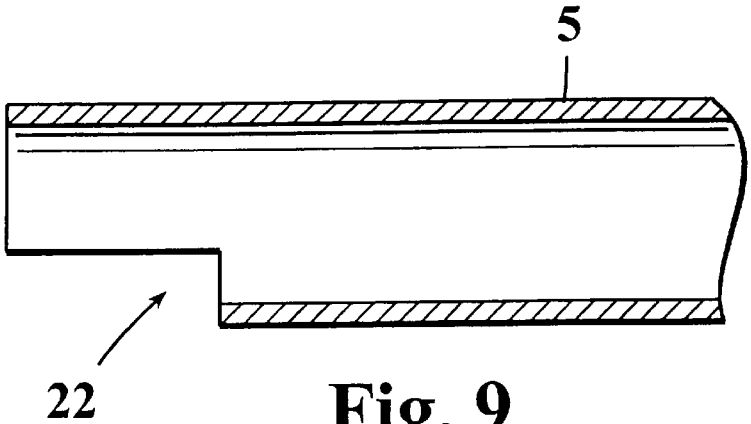
FIG. 9 shows a component of the embodiment illustrated in FIG. 7.

In FIGS. 7–9 is shown a simplified embodiment of the invention. Due to its streamlined design, this embodiment is in many applications more cost-efficient than the arrangement described above. However, the above-described assembly is more suitable for use in locations where extremely heavy rolls are handled on core shafts, because it allows the lift fork to be designed sufficiently rugged. The simplified embodiment illustrated in FIG. 7 is, however, preferred in the handling of tissue web rolls on core shafts, because these rolls are relatively lightweight as compared with the heavy rolls of printing paper grades, whereby the handling of tissue web rolls does not require such rugged handling equipment.

In the embodiment shown in FIG. 7, at the region where the roll change tube 5 reaches the rotatable support 15, the end of the tube is provided with a cut-out relief portion 22 made by removing a portion of the tube 5 shell. Longitudinally, the cut-out relief portion 22 extends from the end of the roll change tube 5 up to a given portion of the width dimension of the coupling portion 20 of the core shaft 1 so that the support element has a sufficient space to support the core shaft 1 from below by engaging its coupling portion 20. However, the width of the cut-out relief portion 22 must be made shorter than the longitudinal width of the core shaft coupling portion 20 so that the full-bore end of the roll change tube 5 can reach despite the cut-out relief portion 22 below the coupling portion 20, thereby being capable of supporting the core shaft 1. Due to this requirement, the length of the cut-out relief portion must be made shorter than the length of the coupling portion 20. The upper side of the roll change tube 5 must be contiguous at least at the highest position of the tube surface in order to allow the roll cores to slide smoothly away from the shell of the core shaft 1 onto the roll change tube 5. On the other hand, the underside of the roll change tube can be provided with a very short cut-out relief portion only, because the support 15 only makes touching contact with the underside of the coupling portion 20. Hence, the dimensioning of the cut-out relief portion within this region is chiefly determined by the dimensions and structure of the coupling portion 20 and the support 15. As to the strength of the shaft-engaging end of the roll change tube, it is obviously advantageous to make the cut-out relief portion as narrow as possible in the radial direction of the tube 5, because then the stiffness of the tube end is retained as high as possible.

The function of the above-described embodiment is as follows.

The core shaft 1 with the rolls 10, 11 resting thereon moves to the end of the transfer rails 2, 3 and the roll change tube 5 is moved against the shell end of the core shaft 1. The cut-out relief portion 22 at the end of the roll change tube 5 facilitates the engagement of the tube 5 with the coupling portion 20 while the support 15 mounted to the end of the transfer rail 3 continuously supports the end of the core shaft 1 at the coupling portion 20. Once the end of the roll change tube 5 meets the shell end of the core shaft 1 at the upper edge of the tube, the uncut full-bore portion of the roll change tube 5 surrounds the end of the coupling portion 20 thus allowing the roll change tube 5 to support the core shaft. In this position, the support 15 can be rotated down and thereby the core shaft 1 remains resting on the roll change tube. Subsequently, the rolls can be pushed by a pusher means onto the reel change tube. In this embodiment, the pusher does not need be a rugged lift fork, but a less rugged pusher means may serve as well. After the rolls 10, 11 have been moved onto the reel change tube, the support 15 is rotated upward to re-support the end of the core shaft and the reel change tube 5 is withdrawn away from surrounding the coupling 20 of the core shaft. Next, the roll core handler 12 is rotated, whereby the core change tube 5 and the rolls 10, 11 are moved into the roll delivery position, and simultaneously the core change tube 8 with new roll cores 9 threaded thereon is aligned with the longitudinal axis of the reel shaft 1 and then pushed onto the end of the core shaft 1. The core change tube 8 has a similar cut-out relief portion as that made on the roll change tube 5. After the support 15 is again lowered, the roll cores can be pushed onto the reel shaft, whereupon the support may again rise and the core shaft is again ready for the next winding steps and the core change tube can be withdrawn from the end of the core shaft.

Figure 10:
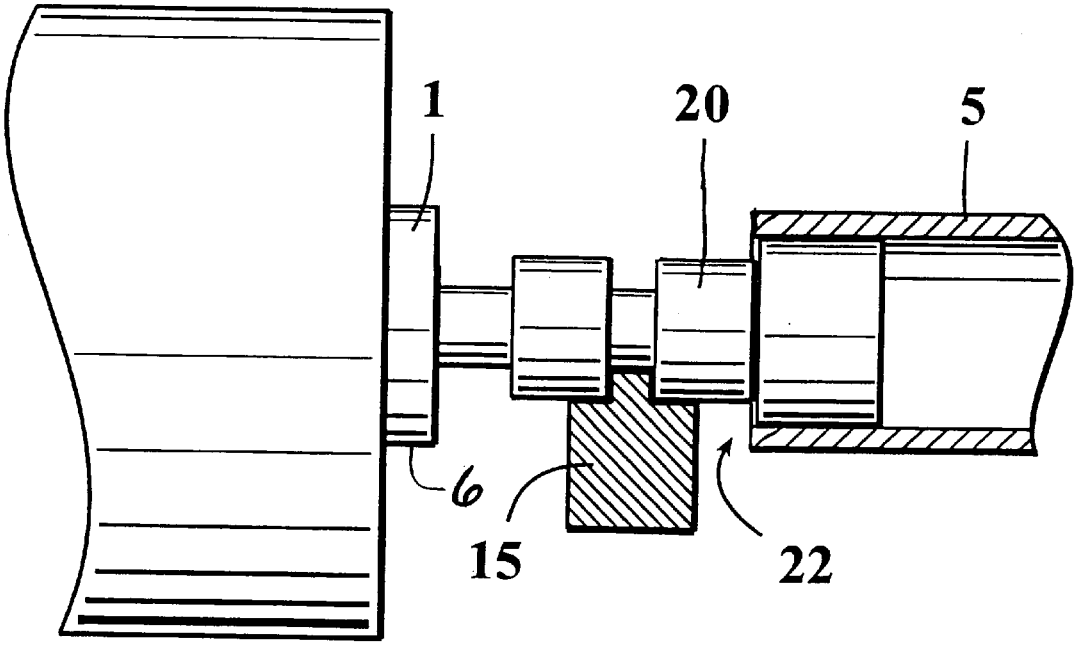
FIG. 10 shows one further embodiment of the invention.

FIG. 10 shows a further embodiment of the invention. In this embodiment the end of the roll change tube 5 is left on the end of the core shaft 1. This leaves a gap of 500–600 mm between the end of the roll change tube 5 and the end of the core shaft 1 shell. Since the parent rolls 10, 11 are usually several even up to 5 meters long, the rolls can be easily pushed over the gap. Or course, it is clear that this embodiment is not suitable for processes handling very short rolls. On the operation of this embodiment it must be noted that the core shaft must be locked in the axial direction either by a stopper built within the roll change tube 5 or a suitable restraining apparatus at the opposite end of the core shaft 1.

Many modifications and other embodiments of the inventions set forth herein will come to mind to one skilled in the art to which these inventions pertain having the benefit of the teachings presented in the foregoing descriptions and the associated drawings.

For example, it is to be understood that a non-split web can be wound on a single core threaded on the core shaft, and if the web is split more than twice, the number of cores can be three or greater.

Furthermore, the mutual position of the tubes 5, 8 may be arranged different from what is described above. The tubes 5, 8 may be located on the same axis for instance, whereby the rotational movement of the roll core handler may cover an angle of, e.g., 90° or 180°. However, the exemplifying embodiment described above can offer smaller movements combined with a short transfer time. The roll core handler need not necessarily be designed movable, but instead the movements of the roll change tube and the core change tube in the direction of the core shaft longitudinal axis can be implemented by virtue of moving the tubes on guides or supported on telescoping cylinders or the like. Obviously, the lift fork could be moved above the core shaft, but this arrangement makes connection to the core shaft more difficult. A single lift fork may be replaced by a combination of two separate fork ends, whereby their movement toward the core shaft ends can be implemented in different manners. It is even possible to omit the lift fork totally. In such an embodiment the roll change tube is pushed over the end of the core shaft so that it engages the outer end of the coupling means and supports the core shaft. When the support at the end of the transfer rail is removed, the roll change tube can be pushed further over the end of the core shaft to make the support more secure. The roll change tube can be pushed against the shell end of the core shaft or left at a distance thereof. The disadvantage of this embodiment is that the weight of the parent rolls and the shaft rests largely on the end of the roll change tube whereby it is heavily stressed and moving it requires high force because of friction.

Furthermore, an additional separate roll core handler can be placed close to the other end of the core shaft, thus achieving a reduced core change time. Correspondingly, the core change tube and the roll change tube can be located on different sides of the core shaft. The roll change tube may also be made movable only in the direction of the core shaft longitudinal axis, whereby it can also serve as the core change tube. Instead of running on the transfer rails, the core shafts may be introduced into the roll change position by lifting and then placed there on suitable support blocks or directly on the lift forks. Although certain elements in the foregoing text have been called as a "tube", it is obvious that these elements may as well be implemented using bar cages or other similar constructions known in the art. Hence, their outer surface need not necessarily be defined by a cylindrical shell inasmuch as an equivalent element with a prismatic or even a radially outwardly ridged envelope of an elongated shape will serve the desired-purpose as long as the longitudinal projections of the element mate in the desired manner with the inner diameter of the core. Similarly, all other terms used to describe the different elements must be understood as descriptive and general names of the elements only, rather than as technical terms limiting to the implementation of the invention. For instance, the construction of the lift fork may in reality have any other form of a support element instead of being a forked structure. Instead of utilizing rotation, the support element or elements mounted at the end of the transfer rail can be arranged to be movable in the horizontal or vertical direction, or along an inclined trajectory, or the support(s) may be located on the opposite side of the core shaft in regard to the transfer rails.

What is claimed is:

1. A method for transferring one or more tissue web rolls from a core shaft, the core shaft having a shell portion and having first and second coupling portions that respectively project beyond opposite first and second ends of the shell portion, the method comprising the steps of:

transferring the core shaft into a core shaft change position;

supporting the core shaft in the core shaft change position by first and second supports that engage the core shaft proximate the first and second ends of the shell portion, respectively;

moving a roll change tube into coaxial relation with the core shaft so that a shaft-engaging end of the roll change tube at least partially engages the first coupling portion;

removing the first support from the core shaft such that the core shaft is supported at one end by the second support and at the other end by the roll change tube; and axially pushing the one or more tissue web rolls from the core shaft onto the roll change tube.

2. The method of claim 1, wherein the first support engages the core shaft at a support location that is between and spaced from an outer end of the first coupling portion and the first end of the shell portion, and wherein the roll change tube engages the first coupling portion such that a gap exists between the shaft-engaging end of the roll change tube and the first end of the shell portion of the core shaft.

3. The method of claim 1, wherein the first support engages the core shaft at a support location that is between and spaced from an outer end of the first coupling portion and the first end of the shell portion, and wherein at least a portion of the shaft-engaging end of the roll change tube is brought to abut the first end of the shell portion.

4. The method of claim 3, wherein an upper part of the shaft-engaging end of the roll change tube is brought to abut the first end of the shell portion of the core shaft while a lower part of said shaft-engaging end has a longitudinally extending cut-out relief portion for accommodating the first support, a longitudinal length of said cut-out relief portion being shorter than a longitudinal length of the first coupling portion of the core shaft such that an uncut full-bore portion of the roll change tube supports the first coupling portion over a part of the length thereof.

5. The method of claim 1, wherein the first support engages the shell portion of the core shaft to support the core shaft so that the first coupling portion remains free, the shaft-engaging end of the roll change tube is moved to fit about the first coupling portion and to abut the first end of the shell portion, and the first support is then disengaged from the shell portion so that the roll change tube supports the core shaft.

6. The method of claim 1, wherein the step of transferring the core shaft into the core shaft change position comprises transferring the core shaft onto a pair of spaced support members that support opposite ends of the core shaft, the first support comprising a movable end portion of one of the support members, and wherein the step of removing the first support comprises moving the movable end portion of the one support member so as to disengage the core shaft.

7. The method of claim 1, wherein during the axial pushing of the one or more tissue web rolls onto the roll change tube, the core shaft is supported in the direction of said axial pushing by the second support and by the shaft-engaging end of the roll change tube.

8. The method of claim 1, wherein after the one or more tissue webs rolls have been pushed onto the roll change tube, the first support is re-engaged with the core shaft and the shaft-engaging end of the roll change tube is disengaged from the core shaft, and the roll change tube is moved away from the core shaft into a delivery position for the one or more tissue web rolls.

9. The method of claim 8, wherein the roll change tube is moved into the delivery position by pivoting the roll change tube about a pivot point proximate one end of the roll change tube.

10. The method of claim 9, wherein simultaneously with pivoting the roll change tube about the pivot point, a core change tube carrying one or more new cores is pivoted about said pivot point into a position coaxially aligned with the core shaft, and the one or more new cores are pushed axially onto the core shaft.

11. An apparatus for transferring one or more tissue web rolls from a core shaft having a shell portion and having first and second coupling portions that respectively project beyond opposite first and second ends of the shell portion, the apparatus comprising:

first and second supports structured and arranged to engage the core shaft proximate the first and second ends of the shell portion, respectively, so as to support the core shaft with the one or more tissue web rolls, at least the first support being movable between a position engaging the core shaft and a position disengaged from the core shaft;

a roll change tube having a shaft-engaging end configured to fit at least partially about the first coupling portion of the core shaft, the roll change tube being configured to slidably receive the one or more tissue web rolls thereover;

a roll core handler coupled with the roll change tube and operable to position the roll change tube in coaxial end-to-end alignment with the core shaft and to axially move the roll change tube so as to engage the shaft-engaging end of the roll change tube with the first coupling portion of the core shaft, the roll core handler and roll change tube being structured and arranged such that when the first support is disengaged from the core shaft, the core shaft and the one or more tissue web rolls are supported by the roll change tube's engagement with the first coupling portion and by the second support's engagement with the core shaft; and a pusher operable to engage the one or more tissue web rolls on the core shaft and to push the one or more tissue web rolls onto the roll change tube.

12. The apparatus of claim 11, wherein the shaft-engaging end of the roll change tube has an upper part configured to be compatible with the shell portion of the core shaft and a lower part that includes a longitudinally extending cut-out relief portion, the cut-out relief portion having a longitudinal length less than that of the first coupling portion whereby an uncut full-bore portion of the roll change tube is able to fit about the first coupling portion.

13. The apparatus of claim 11, wherein the roll core handler is operable to move the roll change tube in a direction defined by a longitudinal center axis of the core shaft as well as to pivot the roll change tube about a pivot point located on an extension of the longitudinal center axis of the core shaft.

14. The apparatus of claim 13, further comprising a core change tube coupled with the roll core handler for carrying new cores to be installed on the core shaft after removal of the one or more tissue web rolls therefrom, the core change tube being oriented at a fixed angle relative to the roll change tube such that pivoting the roll change tube about the pivot point by said angle moves the roll change tube out of coaxial alignment with the core shaft and moves the core change tube into coaxial alignment with the core shaft.

15. The apparatus of claim 14, further comprising a core-handling table in a position meeting the core change tube when the roll change tube is coaxially aligned with the core shaft.

16. The apparatus of claim 11, wherein at least one of the first and second supports is structured and arranged to prevent longitudinal movement of the core shaft by engaging one of the coupling portions thereof.

17. The apparatus of claim 16, wherein the first and second supports comprise spaced rails on which the coupling portions of the core shaft rest, the movable first support comprising a movable portion of one of the rails.

* * * * *

UNITED STATES PATENT AND TRADEMARK OFFICE

CERTIFICATE OF CORRECTION

PATENT NO. : 6,722,605 B2
DATED : April 20, 2004
INVENTOR(S) : Joutsjoki

It is certified that error appears in the above-identified patent and that said Letters Patent is hereby corrected as shown below:

Title page,
Insert the following:

-- [30] Foreign Application Priority Data
April 12, 2000 (FI)……..20000877 --.

Signed and Sealed this

Seventeenth Day of August, 2004

JON W. DUDAS
*Acting Director of the United States Patent and Trademark Office*